US007963781B2

(12) United States Patent
Takahashi et al.

(10) Patent No.: US 7,963,781 B2
(45) Date of Patent: Jun. 21, 2011

(54) LOW INSERTION FORCE CONNECTOR

(75) Inventors: Toshiharu Takahashi, Makinohara (JP); Kazuto Ohtaka, Makinohara (JP); Tetsuya Mitani, Walco (JP)

(73) Assignees: Yazaki Corporation, Tokyo (JP); Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/367,779

(22) Filed: Feb. 9, 2009

(65) Prior Publication Data

US 2009/0203251 A1 Aug. 13, 2009

(30) Foreign Application Priority Data

Feb. 12, 2008 (JP) ..... 2008-029888

(51) Int. Cl.
*H01R 13/62* (2006.01)

(52) U.S. Cl. ..... 439/157

(58) Field of Classification Search ..... 439/157, 439/376, 374, 372

See application file for complete search history.

(56) References Cited

U.S. PATENT DOCUMENTS

| | | | | |
|---|---|---|---|---|
| 5,230,635 | A | 7/1993 | Takenouchi et al. | |
| 5,954,528 | A * | 9/1999 | Ono et al. | 439/157 |
| 6,036,510 | A * | 3/2000 | Ono et al. | 439/157 |
| 6,364,681 | B1 | 4/2002 | Watanabe | |
| 6,488,516 | B2 * | 12/2002 | Osawa et al. | 439/157 |
| 6,685,496 | B2 * | 2/2004 | Ookura | 439/372 |
| 7,775,815 | B2 * | 8/2010 | Takahashi et al. | 439/157 |
| 2006/0178049 | A1 | 8/2006 | Ishikawa | |
| 2007/0184692 | A1 | 8/2007 | Ohtaka et al. | |

FOREIGN PATENT DOCUMENTS

| | | |
|---|---|---|
| DE | 10 2007 001 514 A1 | 7/2007 |
| JP | 2004-103557 | 4/2004 |

* cited by examiner

*Primary Examiner* — T C Patel
*Assistant Examiner* — Phuong Nguyen
(74) *Attorney, Agent, or Firm* — Morgan, Lewis & Bockius LLP

(57) ABSTRACT

The present invention provides a LIF (Low Insertion Force) connector fixing a vehicle body panel capable of reducing the number of parts and improving workability. The LIF connector fixed to a vehicle body panel includes a frame including a first guide groove, a first connector connected to the frame so as to be rotated and including a second guide groove, a second connector having a first boss and connected to the first connector by rotating the first connector from a position where the first boss is inserted into the first and the second guide groove at the same time.

13 Claims, 16 Drawing Sheets

LOW INSERTION FORCE CONNECTOR

BACKGROUND OF THE INVENTION

The present invention relates a LIF (low insertion force) connector fixing a vehicle body panel. The LIF connector has a mechanism of engaging male and female multi-terminal connectors each having many metallic terminals by low insertion force, and locking-fixing structure for a vehicle body panel.

BACKGROUND ART

An LIF connector disclosed in the Patent Document JP-A-2004-103557 is known. In FIG. 16, an LIF connector 1 is fixed to a not-shown vehicle body panel. The LIF connector 1 includes a connector holder 2 attached to the vehicle body panel, a first connector 3 to be fixed to the connector holder 2, a second connector 4 to be engaged with the first connector 3 with the first connector fixed to the connector holder 2, and a lever 5 rotatably provided on the second connector 4 and making the second connector 4 engaged with the first connector 3 by the rotating operation.

SUMMARY OF THE INVENTION

The above conventional LIF connector 1 is composed of four members; the connector holder 2, the first connector 3, the second connector 4, and the lever 5. Accordingly, the conventional LIF connector 1 has a problem that the LIF connector has a large number of parts. Further, there is also a problem that a large number of parts increase the number of steps up to fix the LIF connector to a not-shown vehicle body panel. Furthermore, there is a problem that workability relating to assembly becomes low in case that a worker must perform the assembly while shifting a component of the connector 1 from one hand to the other during the work, though this case is not limited to the conventional LIF connector 1.

The invention is accomplished in view of the above circumstances, and it is an object of the invention to provide a LIF connector fixing a vehicle body panel capable of reducing the number of parts and improving workability.

A vehicle body panel fixing LIF connector according to a first aspect of the invention made in order to solve the above problems includes a frame including a first guide groove, a first connector connected to the frame so as to be rotated and including a second guide groove, a second connector having a first boss which is inserted into the first and the second guide groove.

Preferably, the first and the second connector are engaged by rotating the frame from a position where the first boss is inserted into the first and the second guide groove at the same time.

Preferably, the frame includes a second boss and the first connector includes a boss guide groove. Alternatively, the first connector includes a second boss and the frame includes a boss guide groove. In this configuration, the frame and the first connector are rotatably connected by the engagement between the boss and the boss guide groove. Preferably, the frame forms a first opening through which the first connector is inserted when the frame and the first connector are connected.

Preferably the first guide groove is formed continuously from the first opening. Preferably, the first connector has a second opening through which the second connector is inserted into the first connector when the first boss is inserted into the first and second guide groove.

Preferably, the second guide groove is formed continuously from the second opening.

According to the invention having such the characteristic, the LIF connector includes three parts. According to the invention, the frame including a part of the LIF mechanism part and the panel locking structure part is effective to reduce the number of parts.

A second aspect of the invention is a LIF connector according to the first aspect, in that the frame has a grommet.

According to the invention having such the characteristic, in case that water proofing property is required, the grommet is further provided. The grommet is held by the grommet holding part formed at the panel butting flange of the frame, and brought into close contact with the vehicle body panel.

A third aspect of the invention is a LIF connector according to the first aspect in that the frame has an arm slit and the first connector has an arm jutting out from the arm slit so that the arm provide a rotational force to the first connector when the low insertion force connector is fitted into the vehicle body panel.

According to the invention having such the characteristic, when the LIF connector is about to be attached to the vehicle body panel with incomplete engagement between the first connector and the second connector, the arm abuts on the vehicle body panel. According to the invention, the incomplete engagement is able to be detected by this abutting. Further, the invention is particularly effective to reduce the number of working steps. Namely, when the LIF connector is further pressed toward the vehicle body panel, the force in the rotational direction is applied to the first connector through the arm abutting on the vehicle body panel. As this rotational force application makes the LIF mechanism part work, engagement between the first connector and the second connector is forcedly performed. Accordingly the LIF connector can be attached to the vehicle body panel with complete engagement between the first connector and the second connector.

The forth aspect of the invention is a LIF connector according to the first aspect of the invention in that the frame has a flexible arm and the first connector has a projection part which prevents the flexible arm from vending under incomplete engagement between the first and the second connector.

According to the invention having such the characteristic, when the LIF connector is about to be attached to the vehicle body panel with incomplete engagement between the first connector and the second connector, the flexible arm abuts on the vehicle body panel. At this time, though the flexible arm is about to vend toward the first connector side, the flexure is prohibited by the projection of the first connector. Hereby, as the abutting state between the flexible arm and the vehicle body panel is maintained, it is impossible to press the LIF connector into the vehicle body panel. Accordingly, the detection of the incomplete engagement is possible. On the other hand, under the complete engagement between the first connector and the second connector, after the flexible arm has abutted on the vehicle body panel, the flexible arm bends toward the first connector side. Therefore, the above abutting state is released, and it is possible to press the LIF connector into the vehicle body panel. Accordingly, attachment of the LIF connector to the vehicle body panel is possible. Further, according to the invention, the projection does not generate an unnecessary displacement of the flexible arm. Therefore, the LIF connector has a structure in which creep deformation of the flexible arm is taken into consideration.

The fifth aspect of the invention is a LIF connector according to the first aspect in that the frame has an arm operating slit, the first connector has a lock part including a flexible lock release arm, and the second connector has a lock arm including lock projection. In this configuration, the lock part is engaged with the lock projection under the engagement between the first and the second connector, and the flexible lock release arm vends by pushing through the arm operating slit so as to release the engagement between the lock projection and the lock part.

According to the invention having such the characteristic, after the LIF connector is detached from the vehicle body panel, when the lock release arm is operated through the arm operating slit, the engagement between the lock projection of the second connector and the lock part of the first connector is released. After the lock release arm is operated, the process of detaching the first and the second connector is able to be performed.

The advantage of the first aspect of the invention is that the LIF connector having the mechanism engaging the first and the second connectors by low insertion force, and the locking and fixing structure for the vehicle body panel includes a smaller number of parts than the conventional LIF connector. Further, since the LIF connector includes a smaller number of parts than the conventional LIF connector, there is an advantage that workability is improved.

The advantage of the second aspect of the invention is that the LIF connector obtains water proofing property due to the grommet attachment.

The advantage of the third aspect of the invention is that the incomplete engagement between the first connector and the second connector is prevented. Thereby, the LIF connector with high reliability is provided.

The advantage of the fourth aspect of the invention is that the incomplete engagement between the first connector and the second connector is detected. Thereby, the LIF connector with high reliability is provided.

The advantage of the fifth aspect of the invention is that the locking state of the LIF connector is readily released by operating the lock release arm and thereafter the detachment process readily proceeds.

DETAIL DESCRIPTION OF THE PREFERRED EMBODIMENTS

Figure 1A:
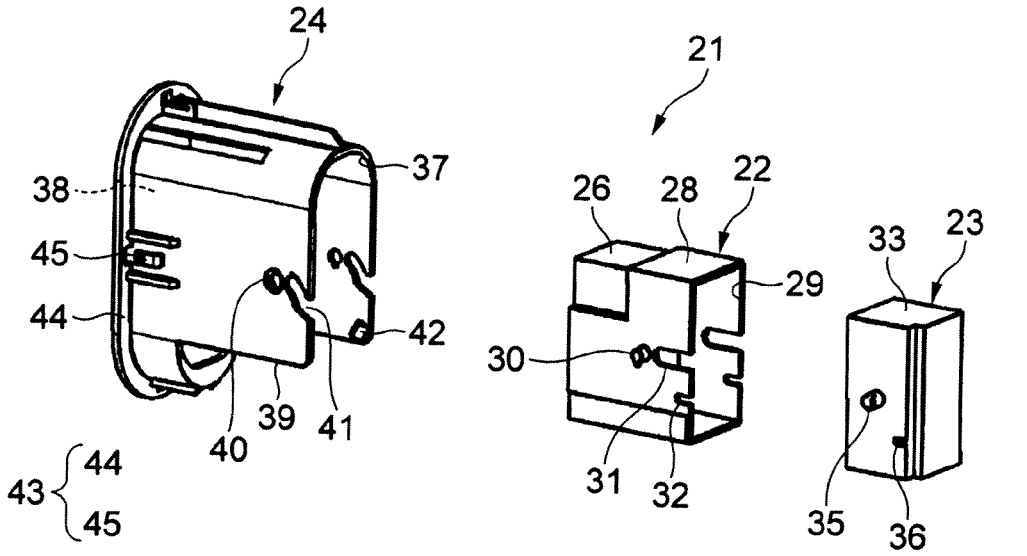
[FIG. 1A] It is diagram showing a vehicle body panel fixing LIF connector according to one embodiment (first embodiment) of the invention described in an exploded perspective view
Figure 1B:
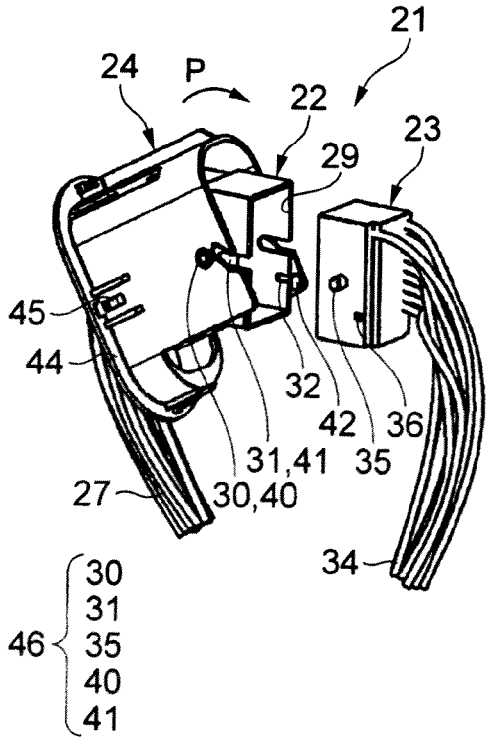
[FIG. 1B] It is diagram showing a vehicle body panel fixing LIF connector according to one embodiment (first embodiment) of the invention described in a perspective view just before a second connector is fitted into a first connector
Figure 1C:
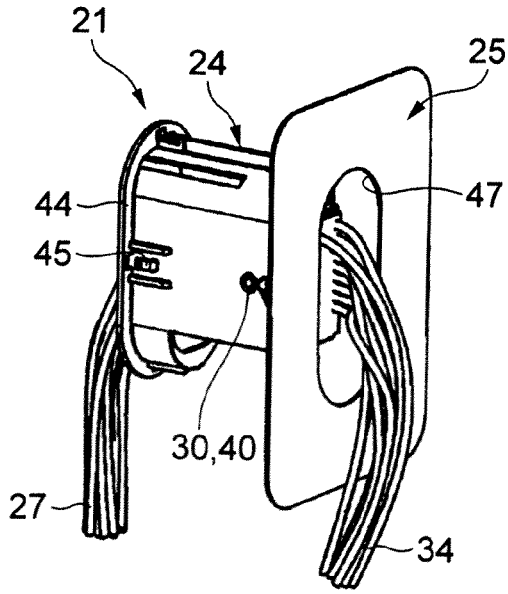
[FIG. 1C] It is diagram showing a vehicle body panel fixing LIF connector according to one embodiment (first embodiment) of the invention described in a perspective view just before the vehicle body panel fixing LIF connector is fitted to a vehicle body panel.
Figure 2A:
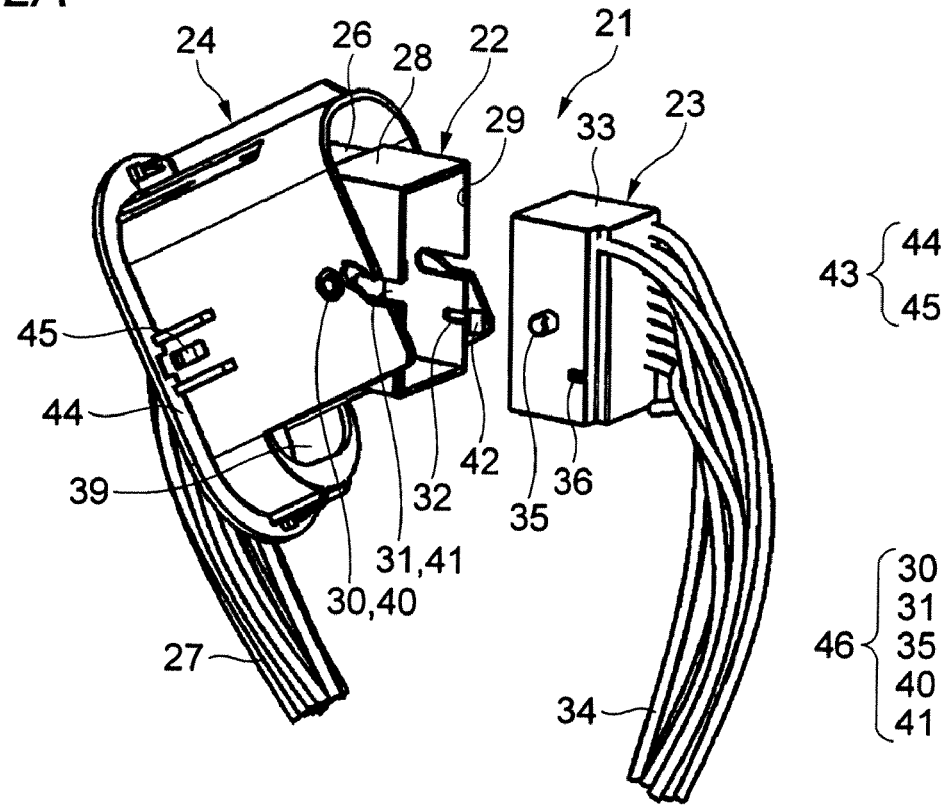
[FIG. 2A] It is a perspective view immediately before the second connector is fitted into the first connector described in a perspective view when the second connector is viewed from one side
Figure 2B:
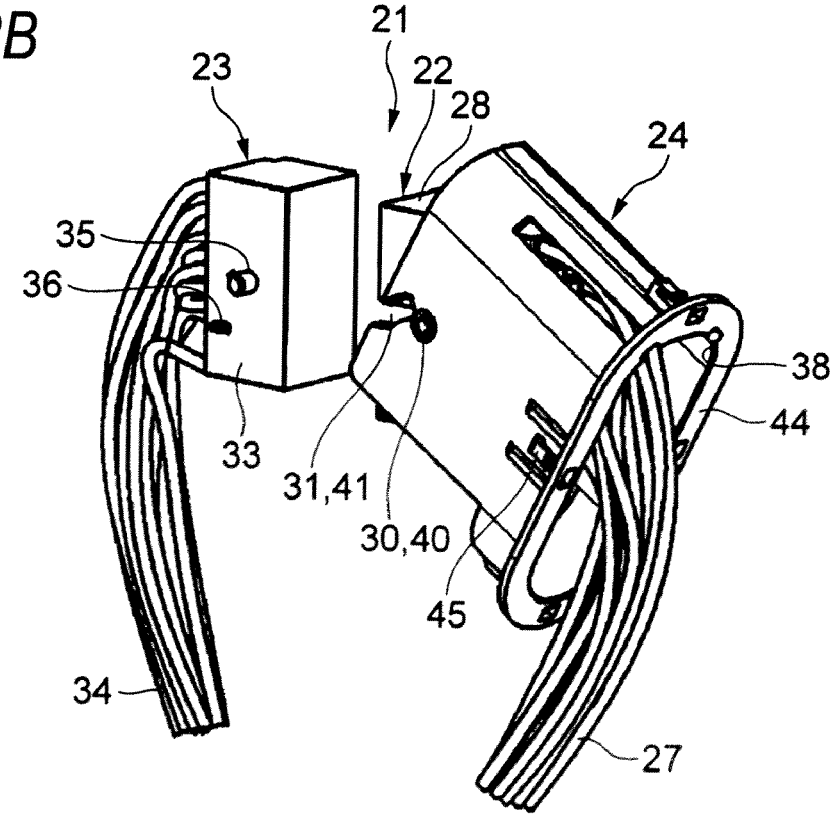
[FIG. 2B] It is a perspective view immediately before the second connector is fitted into the first connector described in a perspective view when a frame is viewed from another side.

Embodiments of the invention are described below with reference to drawings. FIGS. 1A to 1C show a LIF connector fixing a vehicle body panel according to one embodiment of the invention. FIG. 1A is an exploded perspective view, FIG. 1B is a perspective view just before a second connector is engaged with a first connector, and FIG. 1C is a perspective view just before the LIF connector is fitted into a vehicle body panel. Further, FIGS. 2A to 2B are perspective views just before the second connector is engaged with the first connector. FIG. 2A is a perspective view when the second connector is seen from a one side, and FIG. 2B is a perspective view when a frame is seen from another side.

Figure 3A:
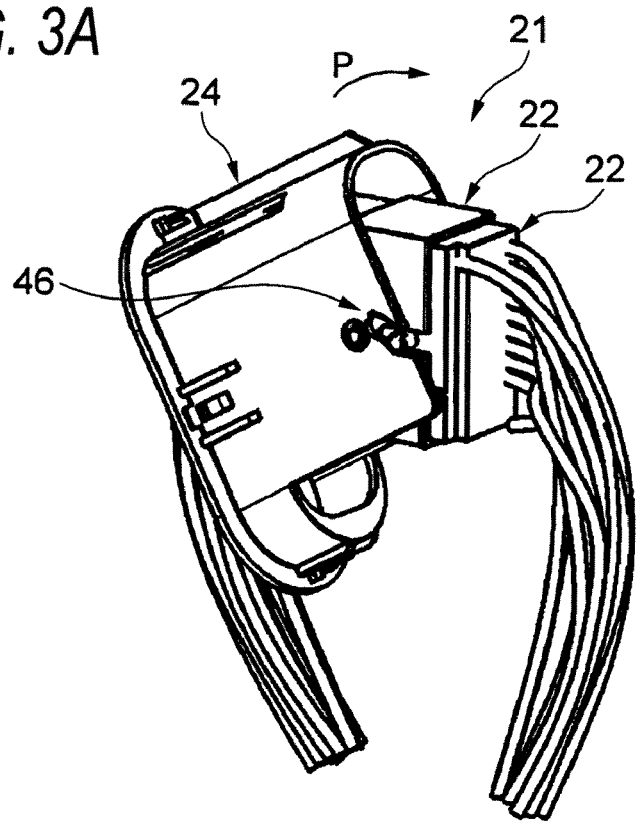
[FIG. 3A] It is a perspective state showing a halfway state of fitting between the second connector and the first connector described in a perspective view when the second connector is viewed from one side
Figure 3B:
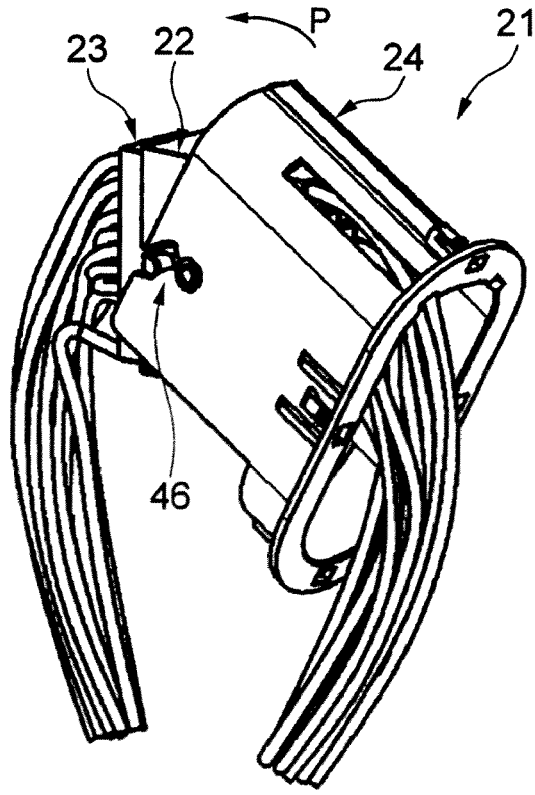
[FIG. 3B] It is a perspective state showing a halfway state of fitting between the second connector and the first connector described in the perspective view when the frame is viewed from another side.
Figure 4A:
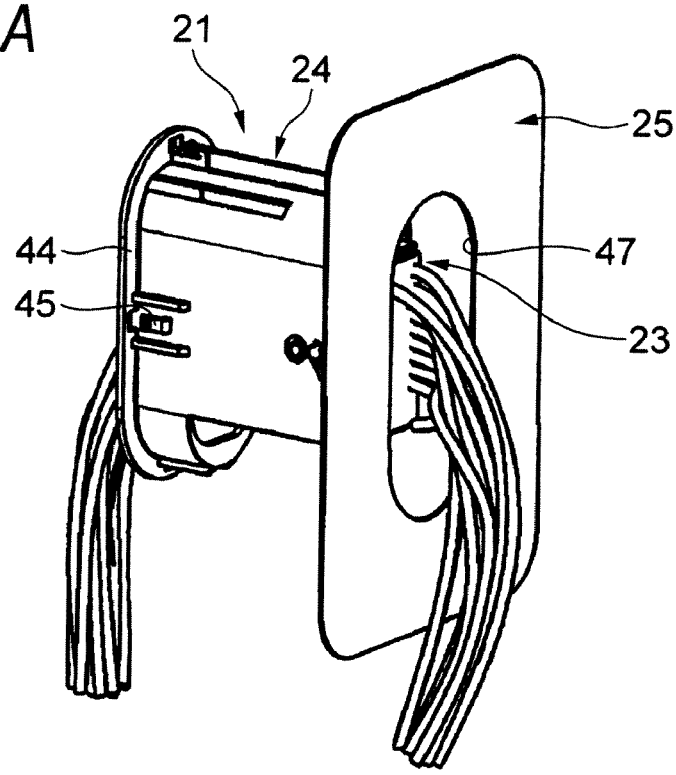
[FIG. 4A] It is a perspective view immediately before the vehicle body panel fixing LIF connector is fitted to the vehicle body panel described in a perspective view when the second connector is viewed from one side
Figure 4B:
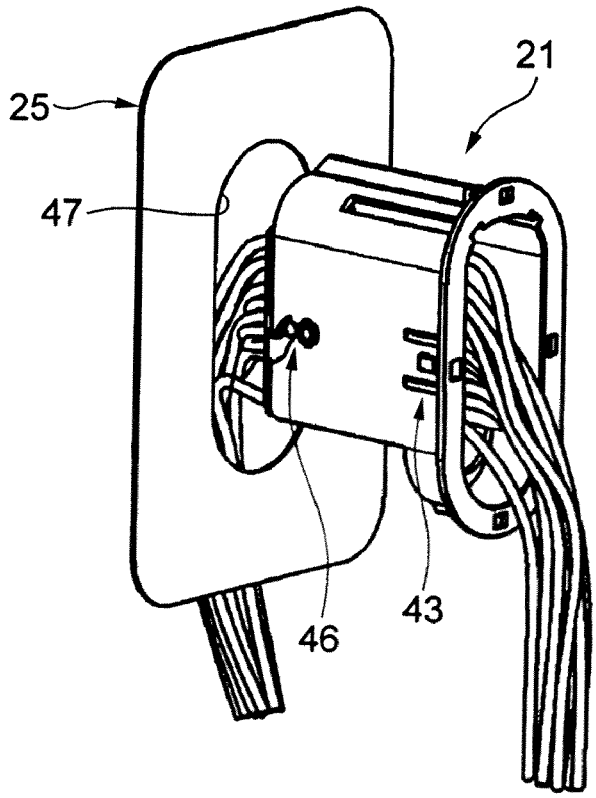
[FIG. 4B] It is a perspective view immediately before the vehicle body panel fixing LIF connector is fitted to the vehicle body panel described in the perspective view when the frame is viewed from another side.
Figure 5:
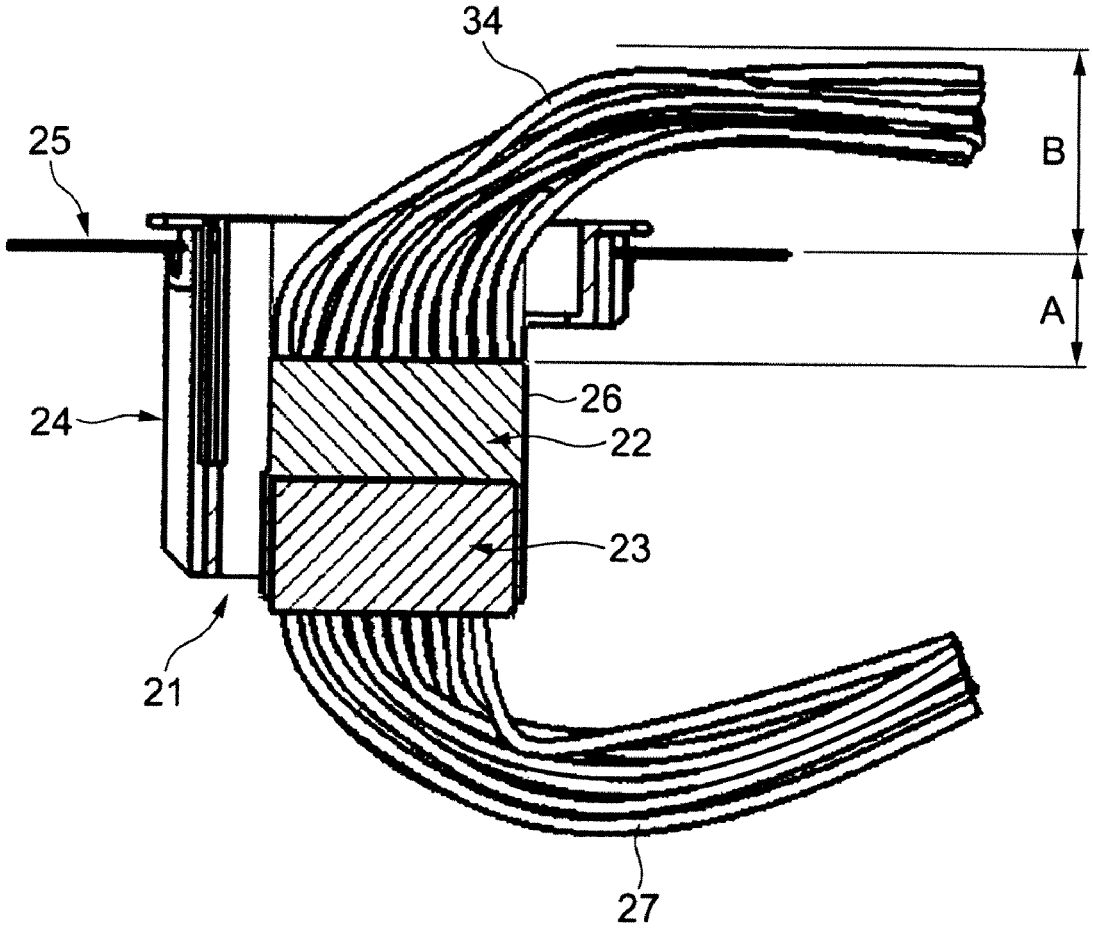
[FIG. 5] It is an explanatory view relating to the protruding amount of an electric wire after the vehicle body panel fixing LIF connector has been fitted to the vehicle body panel.

Further, FIGS. 3A to 3B are perspective views showing an incomplete engagement between the second connector and the first connector. FIG. 3A is a perspective view when the second connector is seen from a one side, and FIG. 3B is the perspective view when the frame is seen from another side. Further, FIGS. 4A to 4B are perspective views just before the LIF connector is fitted to the vehicle body panel. FIG. 4A is a perspective view when the second connector is seen from a one side, and FIG. 4B is the perspective view when the frame is seen from another side. Further, FIG. 5 is an explanatory view relating to the amount of an electric wire jutting out from the LIF connector after the LIF connector is fitted to the vehicle body panel.

In FIG. 1A, a LIF connector 21 fixing a vehicle body panel includes a first connector 22, a second connector 23, and a frame 24. The LIF connector 21 includes three parts. The first connector 22, as shown in FIG. 1B, is attached and accommodated by the frame 24. The first connector 22 and the second connector 23 are engaged with each other by the operation of the frame 24. When the first connector 22 and the second connector 23 are engaged with each other and the LIF connector 21 is formed, as shown in FIG. 1C, the LIF connector 21 is locked to a vehicle body panel 25 and fixed thereto.

First, each part of the LIF connector is described. In FIGS. 1A to 1C, the first connector 22 includes a first connector housing 26 made of insulating synthetic resin, and a male metallic terminal (not shown) accommodated in the first connector housing 26. The male metallic terminal is provided at a terminal of an electric wire 27, and the number of the male metallic terminals is the plural number. The first connector 22 is formed as a multi-terminal connector having a large number of male metallic terminals. From the back portion of the first connector housing 26, a large number of electrode wires 27 are drawn out.

At the front portion of the first connector housing 26, there is formed a connector fitting part 28 into which the second connector 23 is inserted under the engagement of the first connector 22 and the second connector 23. In this connector fitting part 28, an opening 29 which shape is corresponding to the shape of the second connector 23 is formed. Between the opening 29 and a back wall of the connector fitting part 28, inner space is formed. Into this inner space, the not-shown male metallic terminal protrudes. When the connector engagement is performed by inserting the second connector 23 into the connector fitting part 28, the male metallic terminal and a not-shown female metallic terminal of the second connector 23 come into contact with each other thereby to be electrically connected to each other.

In the first connector housing 26, a fulcrum boss 30, an application point boss relief groove 31, and temporary lock projection relief groove 32 are formed (these are formed respectively in pairs). The fulcrum boss 30 is a projection with a circular section, and is arranged and formed near the center of the side portion of the first connector housing 26. The application point boss relief groove 31 is formed in such a shape as to be notched straightly from the opening part 29 to the vicinity of the fulcrum boss 30. The temporary lock projection relief groove 32 is arranged and formed in a temporary lock position at which the first connector 22 and the frame 24 are temporary locked. The temporary lock projection relief groove 32 is formed in such a shape as to be notched straightly and slightly from the opening part 29.

The second connector 23 includes a second connector housing 33 made of insulating synthetic resin, and a female metallic terminal (not shown) accommodated in this second connector housing 33. The female metallic terminal is provided at a terminal of an electric wire 34, and the number of the female metallic terminal is the plural number. The second connector 33 is formed as a multi-terminal connector having a large number of female metallic terminals. From the back portion of the second connector housing 33, a large number of electrode wires 34 are drawn out.

In the second connector housing 33, an application point boss 35, and a lever temporary lock release projection 36 are formed (these are formed respectively in pairs). The application point boss 35 is a so-called cam, which is a projection with a circular section. The application point boss 35 is arranged and formed near the center of the side portion of the second connector housing 33. The lever temporary lock release projection 36 is arranged and formed correspondingly to the temporary lock position at which the first connector 22 and the frame 24 are temporary locked.

The frame 24 has a function as a lever for engaging the first connector 22 and the second connector 23 with each other, and a function as a connector holder for locking the first connector 22 and the second connector 23 to the vehicle body panel 25 when the connectors are engaged. The frame 24 is formed, for example, in the substantial cylindrical shape as shown in the figure. The frame 24 is formed so that its front portion and back portion, and a part of its side portion open. Reference numeral 37 denotes an opening portion of the above front portion. Further, reference numeral 38 (refer to FIG. 2) denotes an opening portion of the above back portion. Further, reference numeral 39 denotes an opening portion of the above side portion.

In the opening part 37 of the frame 24 and in the vicinity of this opening part 37, a fulcrum boss guide hole 40, an application point boss guide groove 41, and a lever temporary lock projection 42 are formed (these are formed respectively in pairs). The fulcrum boss guide hole 40 is formed according to the shape and arrangement of the fulcrum boss 30 of the first connector 22. The frame 24, by the assembly of inserting the fulcrum boss 30 into the fulcrum boss guide hole 40, performs a rotational operation for the first connector 22 in a predetermined direction.

The application point boss guide groove 41 is formed in such a shape as to be obliquely notched from the opening part 37 to the vicinity of the fulcrum boss guide hole 40. The application point boss guide groove 41 is formed as a so-called cam groove. The application point boss guide groove 41 is arranged and formed so that its opening portion overlaps with the application point boss relief groove 31 of the first connector 22 in the temporary lock state between the frame 24 and the first connector 22. The lever temporary lock projection 42 is a projection for making the temporary lock state between the frame 24 and the first connector 22, and is formed so as to be caught in the opening part 29 (in position of the temporary lock projection relief groove 32) in the first connector housing 26 of the first connector 22.

Under the temporary lock state made by the lever temporary lock projection 42 (refer to FIG. 1B), a center axis of the frame 24 does not become parallel to a center axis of the first connector 22, but the frame 24 crosses the first connector 22 at a predetermined angle (when the first connector 22 and the second connector 23 are put in the complete fitting state, the above center axes become parallel to each other).

In the vicinity of the opening part 38 (refer to FIG. 2) of the frame 24, a panel locking structure part 43 which forms the locking structure for the vehicle body panel 25 is formed in plural positions. The panel locking structure part 43 includes a panel butting flange 44 and a panel lock arm 45. The panel butting flange 44 and the panel lock arm 45 are arranged and formed so that the vehicle body panel 25 is interposed therebetween.

The panel butting flange 44 is formed in the shape of such a flange as to come into surface-contact with the vehicle body panel 25. The panel lock arm 45 has a locking portion caught at the vehicle body panel 25, and is formed in the shape of a cantilevered arm. The panel lock arm 45 is formed so as to be capable of releasing the lock state by its own flexure.

Here, a supplementary explanation is given to the first connector 22, the second connector 23, and the frame 24. The fulcrum boss 30, the application point boss relief groove 31, the application point boss 35, the fulcrum boss guide hole 40, and the application point boss guide groove 41 function as an LIF mechanism part 46 for fitting the first connector 22 and the second connector 23 by the low insertion force.

The vehicle body panel 25, for example, a door portion of an automobile or a portion between an engine room and a vehicle room, is formed with a predetermined thickness and formed so as to have a flat surface. In the vehicle body panel 25, a panel through-hole 47 is formed so as to penetrate this panel. The LIF connector 21 is locked and fixed to an opening edge portion of the panel through-hole 47.

Next, with reference to FIGS. 2 to 4, the LIF connector 21 and locking and fixing thereof to the vehicle body panel 25 are described.

After the first connector 22 and the second connector 23 have been formed by the known manufacturing method, first, the frame 24 is attached onto the first connector 22 in the temporary lock state as shown in FIG. 2. Regarding the assembly, in a state where the fulcrum boss 30 of the first connector 22 and the fulcrum boss guide hole 40 of the frame 24 are rotatable, the lever temporary lock projection 42 of the frame 24 is caught in the opening part 29 of the first connector 22 and locks, whereby the temporary lock state is formed.

Next to the temporary lock state, a worker takes the second connector 23 side, for example, with his right hand, and brings this second connector 23 close to the frame 24 and the first connector 22 which are taken with his left hand so as to be opposed to them. Thereafter, the second connector 23 is inserted into the connector fitting part 28, and fitting between the first connector 22 and the second connector 23 is started. At first, the second connector 23 and the first connector is in a position where the application point boss 35 is inserted into the application point boss relief groove 31 and the application point boss guide groove 41 at the same time. The second connector 23 is put in an inserted state into the panel through-hole 47 of the vehicle body panel 25 (refer to FIG. 1C and FIG. 4)

When the second connector 23 is inserted into the connector fitting part 28, the lever temporary lock release projection 36 of the second connector 23 abuts on the lever temporary lock projection 42 of the frame 24, and thereafter the lever temporary lock projection 42 is pressed up by the lever temporary lock release projection 36. Hereby, the above the lever temporary lock projection 42 is released from the lock state described above.

In FIG. 3, engagement between the first connector 22 and the second connector 23 is started by rotating the lever-vehicle body lock member 24 on the left hand side in a direction of an arrow P in the state where the second connector 23 side is taken with the right hand (it is not necessary to pass the second connector 23 from the right hand to the left hand). When the LIF mechanism part 46 works with the rotation of the frame 24, the second connector 23 is drawn toward the first connector 22 side, and a connector fitting state is formed as shown in FIG. 4. Hereby, the assembly of the LIF connector 21 is completed.

After the assembly of the LIF connector 21 has been completed, the LIF connector 21 is inserted into the panel through-hole 47 of the vehicle body panel 25 from the connector fitting state side and lock-fixed thereto. In the lock-fixing time, the panel locking structure part 43 of the frame 24 works. As described above, lock-fixing to the vehicle body panel 25 is completed, and a series of work ends. Further, it is found that the series of work is very good in workability because the number of parts is small and the part is not passed from one hand to the other.

In FIG. 5, the positional relation between the LIF connector 21 in a fixed state to the vehicle body panel 25 and the vehicle body panel 25 is set so that the connector fitting position between the first connector 22 and the second connector 23 is on the downside of the vehicle body panel 25 (in case of FIG. 5). Accordingly, the back end portion of the first connector housing 26 of the first connector 22 is distant from the vehicle body panel 25 by a dimension A, with the result that the wire protruding amount B of the electrode wire 34 which protrudes to the upper side of the vehicle body panel 25 becomes extremely small. By reducing the wire protruding amount B, the LIF connector 21 is designed to be solicitous to interference with the surroundings.

In above first embodiment, the frame 24 has the fulcrum boss guide hole 40 and the first connector housing 26 has the fulcrum boss 30 respectively. Substituting this configuration, it is possible to provide the fulcrum boss 30 on the frame 24 and the fulcrum boss guide hole 40 on the first connector housing 26 in order to perform the present invention.

Figure 6A:
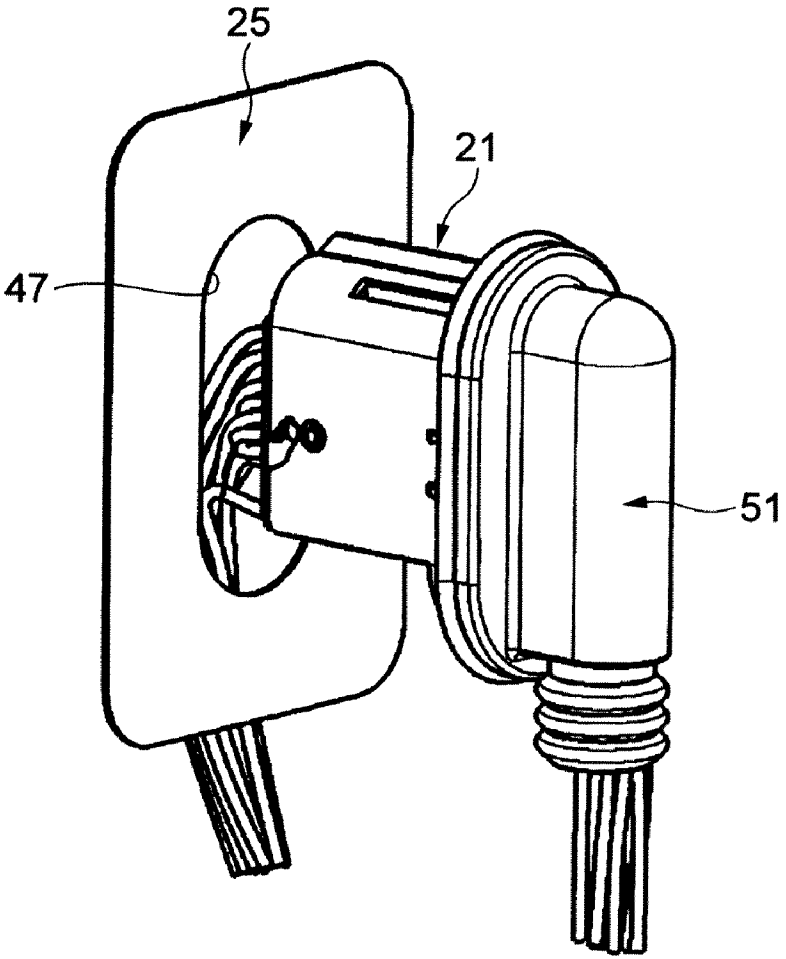
[FIG. 6A] It is a diagram showing a vehicle body panel fixing LIF connector according to a second embodiment of the invention described in an exploded perspective view
Figure 6B:
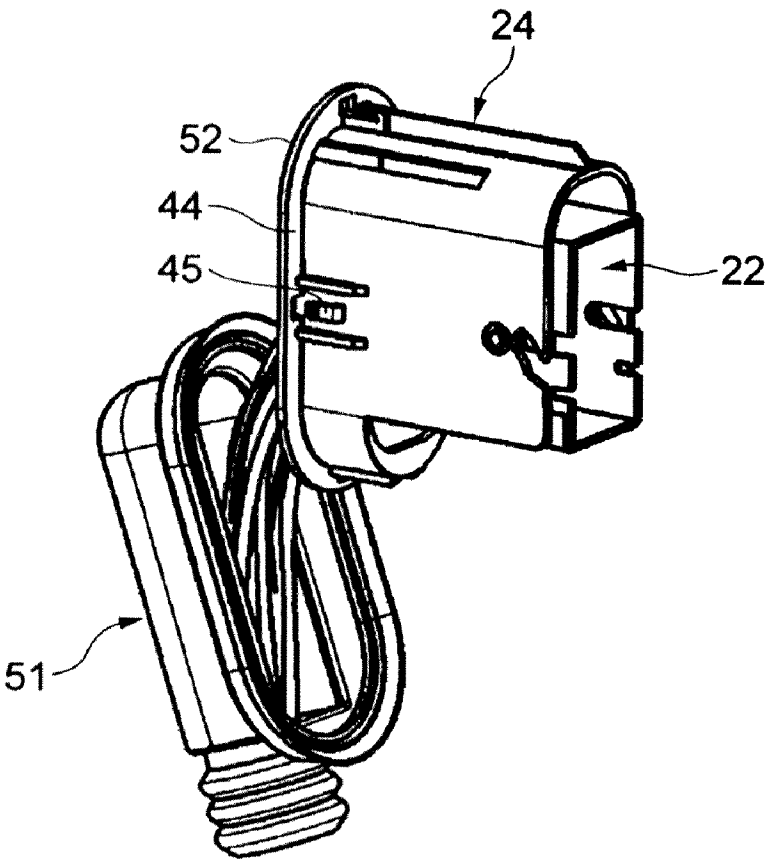
[FIG. 6B] It is a diagram showing a vehicle body panel fixing LIF connector according to a second embodiment of the invention described in a perspective view just before the vehicle body panel fixing LIF connector is fitted to a vehicle body panel.

Next, referring to FIGS. 6A and 6B, a second embodiment of the invention is described. FIGS. 6A and 6B show a LIF connector according to the second embodiment of the invention. FIG. 6A is an exploded perspective view, and FIG. 6B is a perspective view immediately before the vehicle body panel fixing LIF connector is fitted to a vehicle body panel.

In FIG. 6, in the second embodiment, a waterproof glommet 51 is further provided for the LIF connector 21 in the above first embodiment. The glommet 51 is a well-known glommet, and is attached to a frame 24 of the LIF connector 21. At a panel butting flange 44 of the frame 24, a glommet holding part 52 for holding the glommet 51 is formed.

When the LIF connector 21 to which the glommet 51 is attached is locked and fixed to the vehicle body panel 25, the glommet 51 is brought into close contact with the vehicle body panel 25. Therefore, an advantage according to the second embodiment is that the LIF connector 21 obtains water proof property.

Figure 7:
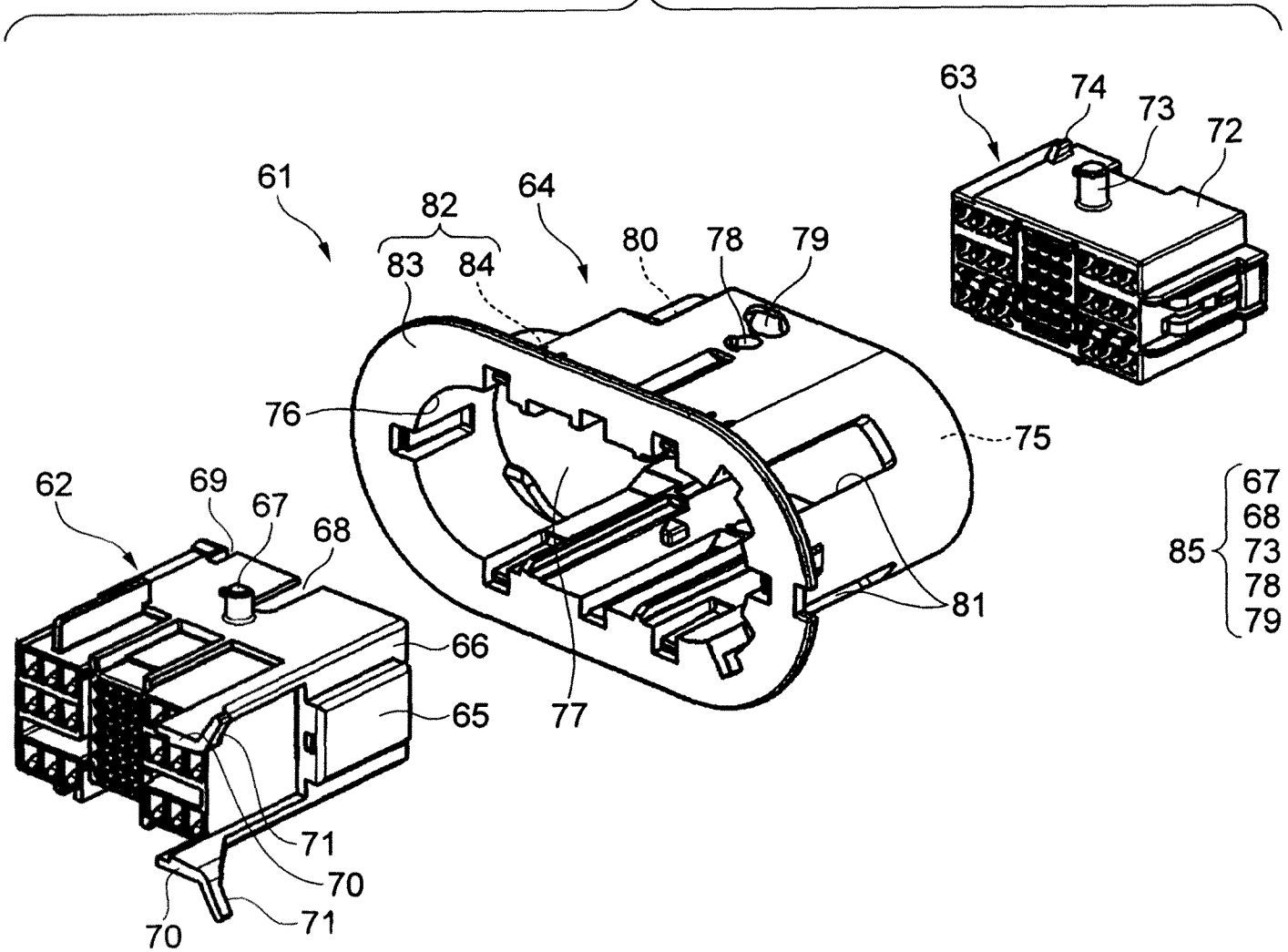
[FIG. 7] It is an exploded perspective view showing a vehicle body panel fixing LIF connector according to a third embodiment of the invention.
Figure 8:
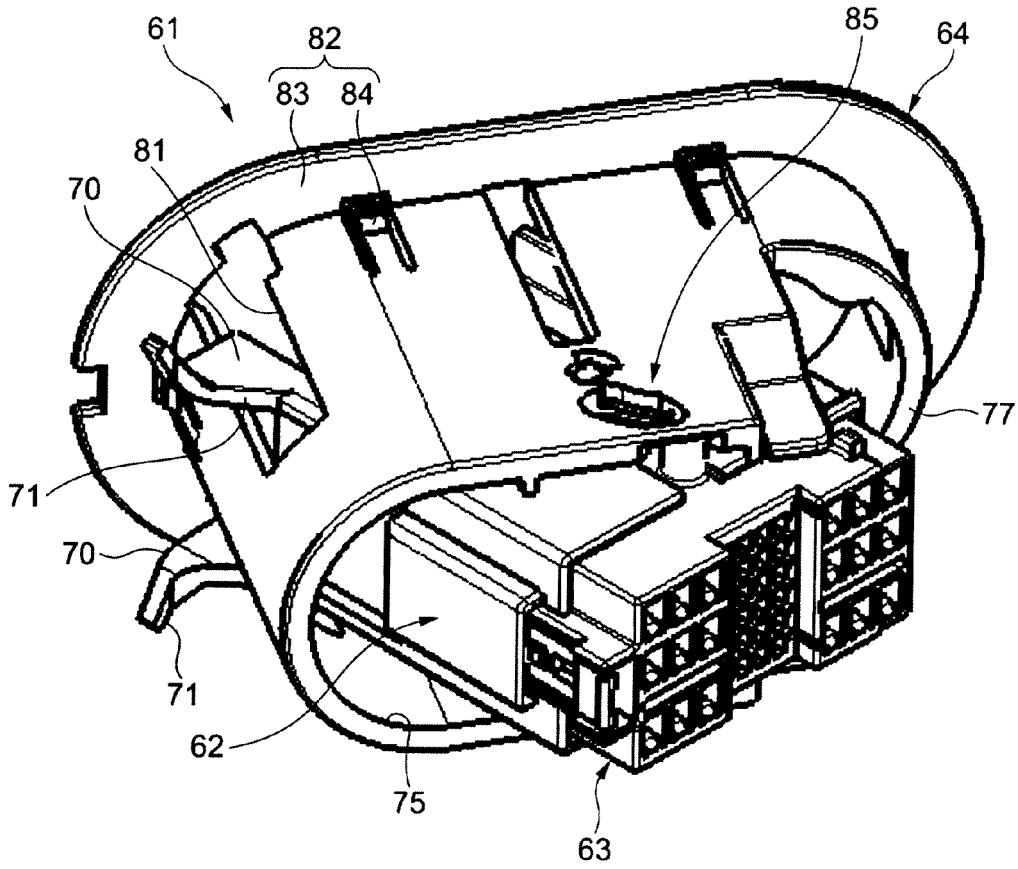
[FIG. 8] It is a perspective view of the vehicle body panel fixing LIF connector in a state where a first connector and a second connector are fitted halfway.
Figure 9:
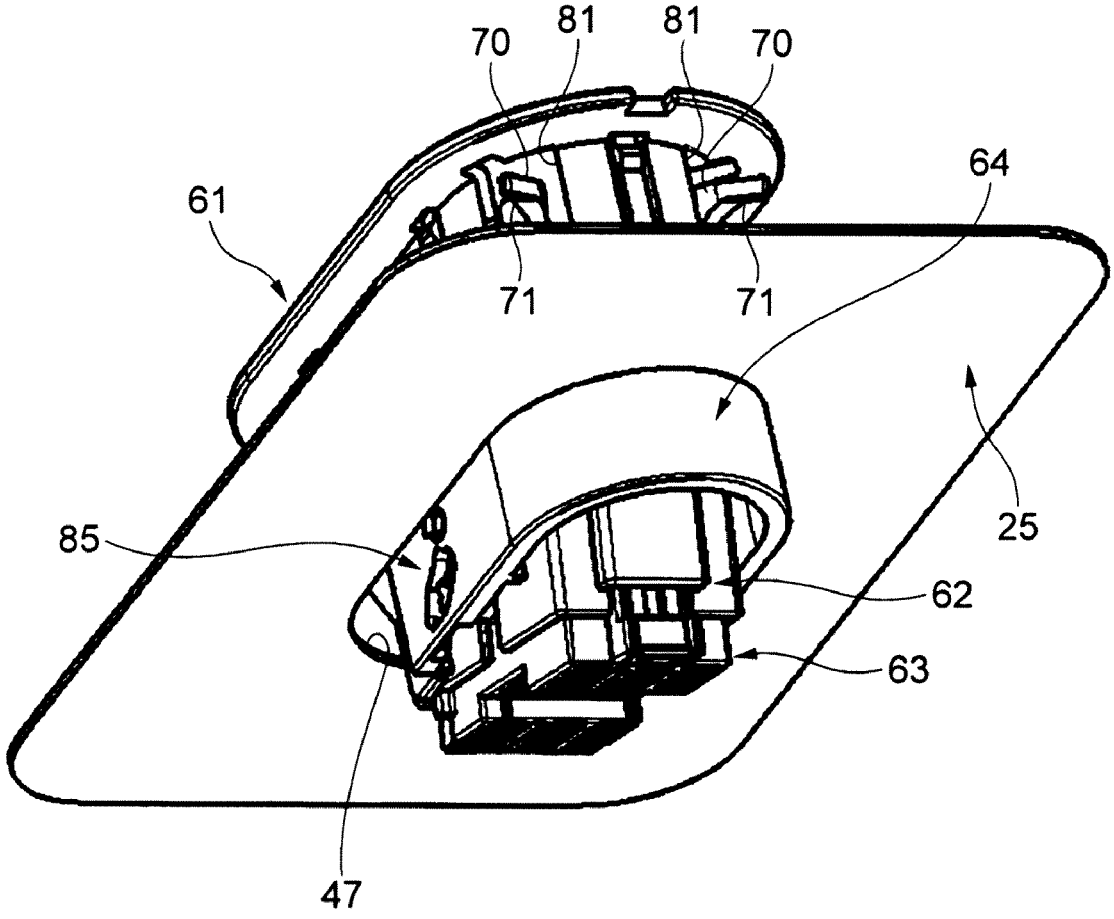
[FIG. 9] It is a perspective view when the vehicle body panel fixing LIF connector is about to be fitted to the vehicle body panel under the halfway fitting state of the first and second connectors.
Figure 10:
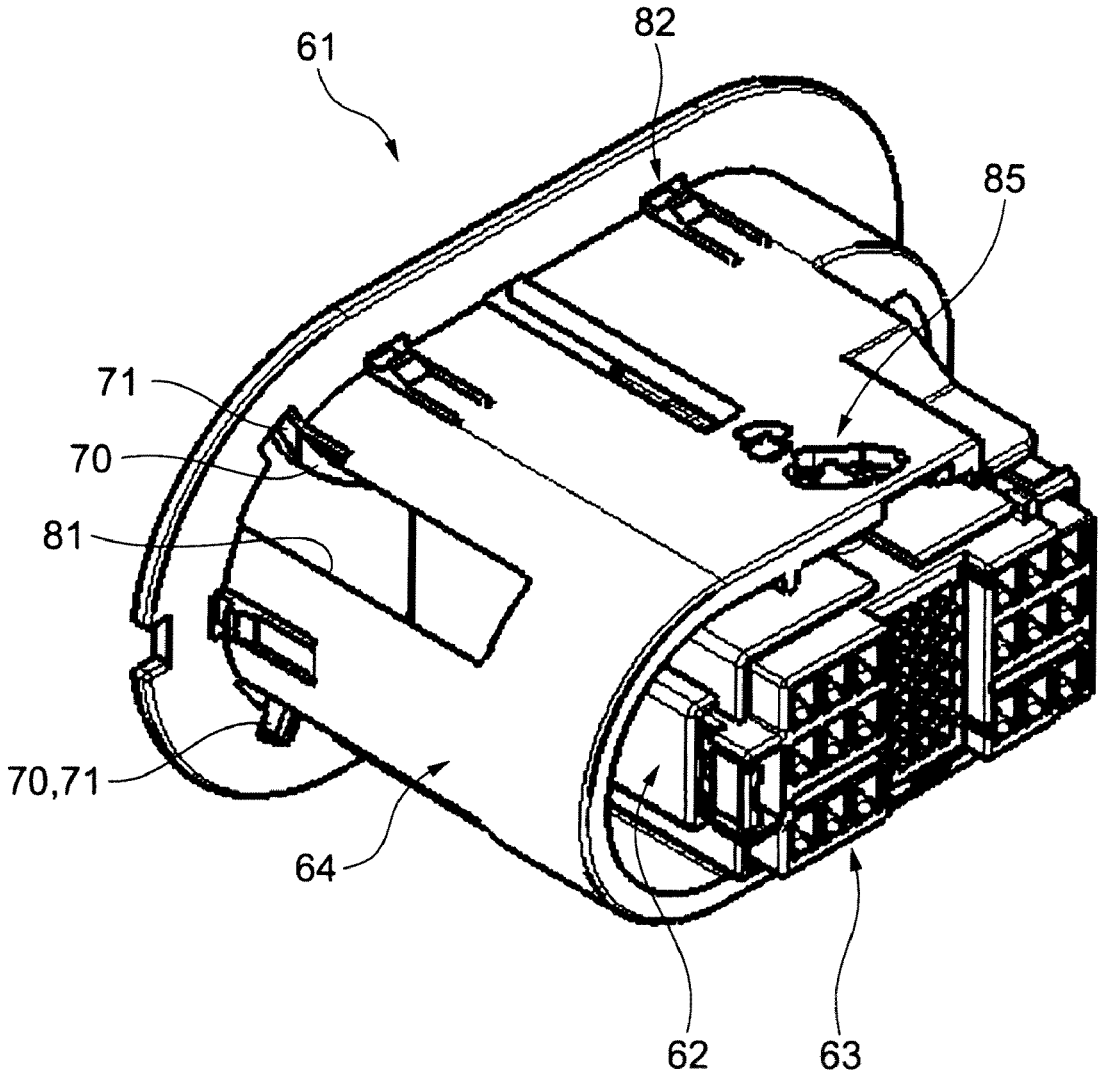
[FIG. 10] It is a perspective view showing a state where fitting between the first connector and the second connector has been forcedly performed.

Next, referring to FIGS. 7 to 10, a third embodiment of the invention is described. FIG. 7 is an exploded perspective view showing a LIF connector according to the third embodiment of the invention. Further, FIG. 8 is a perspective view of the LIF connector under incomplete engagement between a first connector and a second connector, FIG. 9 is a perspective view when the LIF connector is about to be fitted to the vehicle body panel under the incomplete engagement of the first and second connectors, and FIG. 10 is a perspective view showing a state where engagement between the first connector and the second connector is forcedly performed.

In FIG. 7, a LIF connector 61 includes a first connector 62, a second connector 63, and a frame 64. The LIF connector 61 includes three parts. The first connector 62 is assembled to the frame 63 in an accommodated state. The first connector 62 and the second connector 63 are engaged with each other by an operation of the frame 64. When the first connector 62 and the second connector 63 are engaged with each other thereby to form the LIF connector 61, the LIF connector 61 is locked and fixed to a vehicle body panel 25 (refer to FIG. 9).

The first connector 62 includes a first connector housing 65 made of insulating synthetic resin, and a male metallic terminal (not shown) accommodated in this first connector housing 65. In the first connector housing 65, a connector fitting part 66 is formed. Further, in the first connector housing 65, a fulcrum boss 67, an application point boss relief groove 68, and a temporary lock projection relief groove 69 are formed (these are formed respectively in pairs). Further, in the first connector housing 65, a pair of lever halfway forced arms 70 is formed. The lever halfway forced arm 70 is arranged and formed as shown in the figure, and at its leading end, a panel abutting part 71 is formed.

The second connector 63 includes a second connector housing 72 made of insulating synthetic resin, and a female metallic terminal (not shown) accommodated in this second connector housing 72. In the second connector housing 72, an application point boss 73 and a lever temporary lock release projection 74 are formed (these are formed respectively in pairs).

The frame 64 has a function as a lever for engaging the first connector 62 and the second connector 63 with each other, and a function as a connector holder for locking the first connector 62 and the second connector 63 which are in the fitting state to the vehicle body panel 25 (refer to FIG. 9). The frame 64 is formed, for example, in the substantially cylindrical shape as shown in the figure. The frame 64 is formed so that its front portion and back portion, and a part of its side portion open. Reference numeral 75 denotes an opening portion of the above front portion. Further, reference numeral 76 denotes an opening portion of the above back portion. Further, reference numeral 77 denotes an opening portion of a part of the above side portion.

In the frame 64, a fulcrum boss guide hole 78, an application point boss guide groove 79, and a lever temporary lock projection 80 are formed (these are formed respectively in pairs). Further, in the frame 64, a pair of arm relief slit 81 is opened and formed. The arm relief slit 81 is formed on the side portion of the frame 64, and the lever halfway forced arm 70 of the first connector 62 protrudes to the outside from this arm relief slit 81 (refer to FIG. 8) in the incomplete engagement between the first connector 62 and the second connector 63.

A panel locking structure part 82 that becomes locking structure for the vehicle body panel 25 (refer to FIG. 9) is formed in plural portions of the frame 64. The panel locking structure part 82 includes a panel butting flange 83 and a panel lock arm 84. To the base end portion of the panel butting flange 83, the arm relief slit 81 continue.

The fulcrum boss 67, the application point boss relief groove 68, the application point boss 73, the fulcrum boss guide hole 78, and the application point boss guide groove 79 function as an LIF mechanism part 85 (function similarly to in the above first embodiment).

In the above configuration and structure, in a state where the first connector 62 and the second connector 63 are under incomplete engagement as shown in FIG. 8, the lever halfway forced arm 70 of the first connector 62 protrudes to the outside from the arm relief slit 81 of the frame 64. In case that the LIF connector 61 is about to be attached to the vehicle body panel 25 as shown in FIG. 9 under this incomplete engagement, the panel abutting part 71 of the lever halfway forced arm 70 abuts on the vehicle body panel 25. Thereafter, when the LIF connector 61 is further pushed toward the vehicle body panel 25, force in the rotational direction is applied to the first connector 62 through the lever halfway forced arm 70 abutting on the vehicle body panel 25.

When the force in the rotational direction is applied to the first connector 62, the LIF mechanism arm 85 works with this application, whereby the first connector 62 and the second connector 63 is forcedly engaged. By the forced engagement, a complete engagement is achieved as shown in FIG. 10. At this time, there is no protrusion of the lever halfway forced arm 70, with the result that the LIF connector 61 is locked and fixed to the vehicle body panel 25 (refer to FIG. 9), and a series of work ends. The advantage according to the third embodiment is that the LIF connector 61 is attached to the vehicle body panel 25 in the complete engagement between the first connector 62 and the second connector 63.

Figure 11:
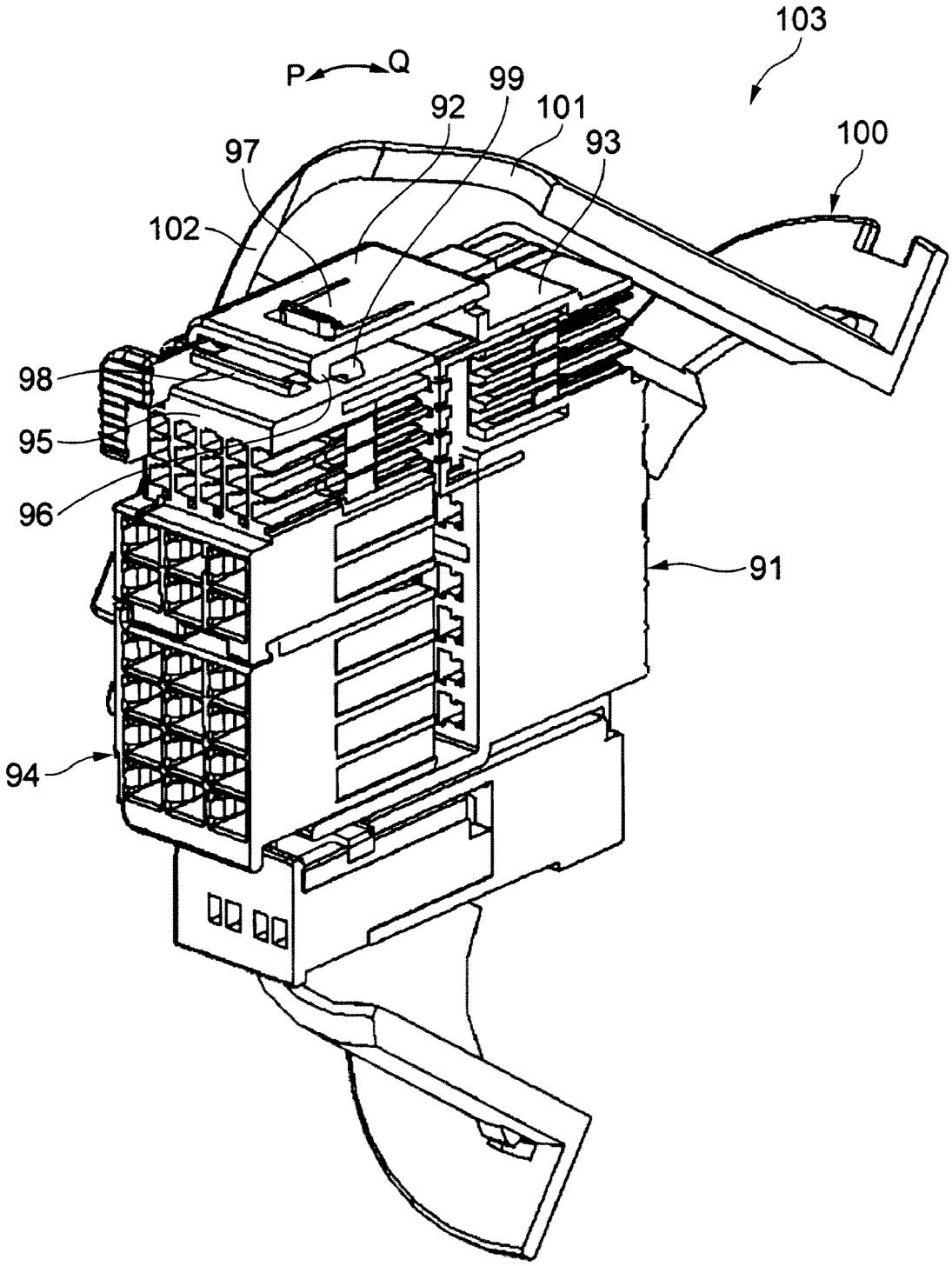
[FIG. 11] It is a diagram relating to a fourth embodiment of the invention, which is a perspective view (including a partial section) showing a state immediately before a first connector housing and a second connector housing are locked.
Figure 12:
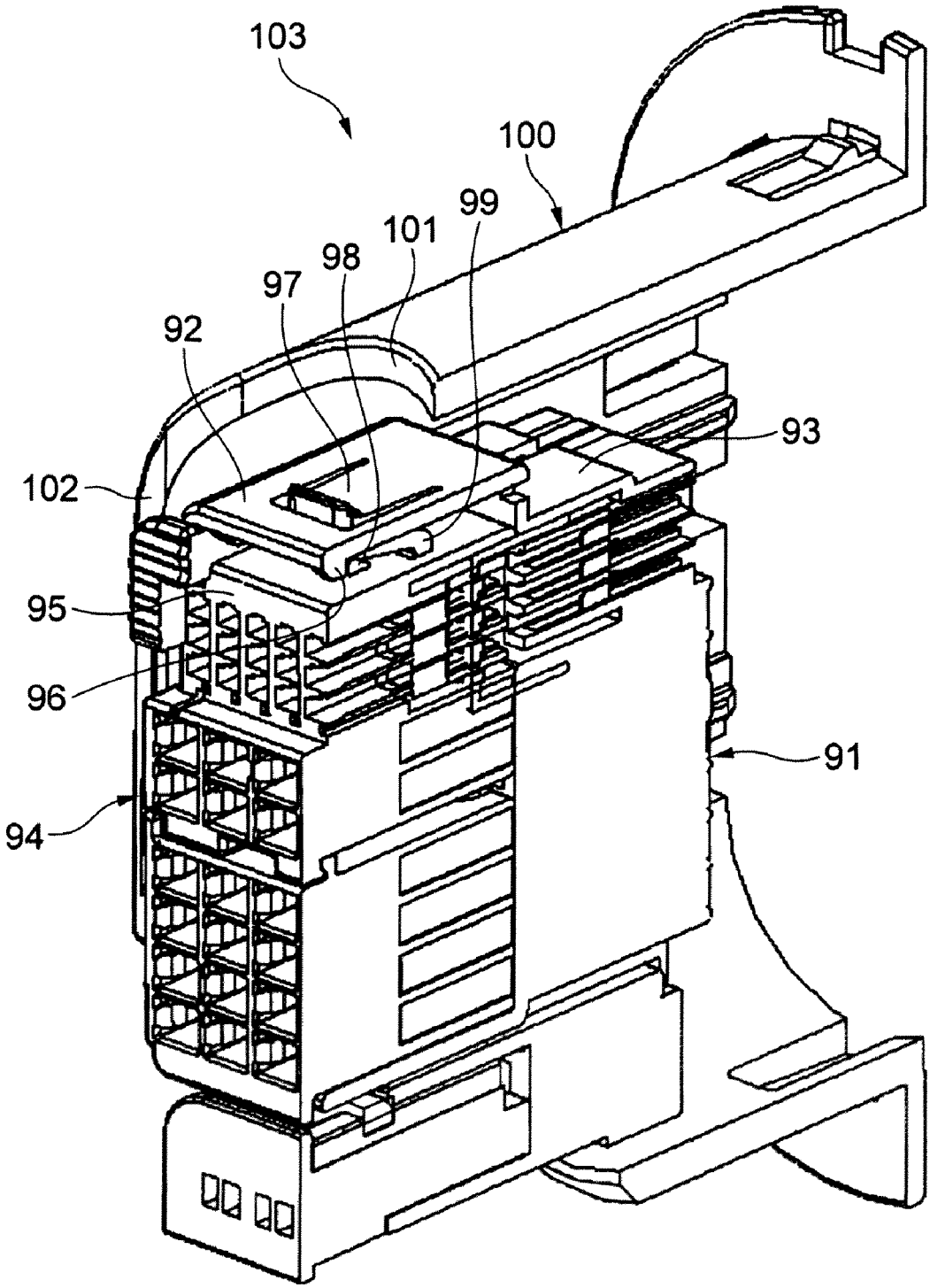
[FIG. 12] It is a perspective view (including a partial section) showing a locking state between the first connector housing and a second connector housing.

Next, referring to FIGS. 11 and 12, a fourth embodiment is described. The fourth embodiment relates to locking structure between a first connector and a second connector in a LIF connector. FIG. 11 is a perspective view showing a state just before a first connector housing and a second connector housing are locked. Further, FIG. 12 is a perspective view showing a locking state between the first connector housing and a second connector housing.

In FIG. 11, a first connector 91 includes a first connector housing 93 having a connector fitting part 92, and plural metallic terminals (not shown) accommodated in this first connector housing 93. Further, a second connector 94 fitted to this first connector 91 includes a second connector housing 95, and plural metallic terminals (not shown) accommodated in this second connector housing 95.

In the connector fitting part 92 located at the side portion of the first connector housing 93, a lock part 96 and a lock release arm 97 are formed. The lock part 96 is a projection part which protrudes to the inner side of the connector fitting part 92, and the lock part 96 is arranged—formed at an opening edge portion of the connector fitting part 92. The lock release arm 97 is formed in the shape of a cantilevered arm having flexibility. The lock release 97 is formed so as to be capable of being flexed inward the connector fitting part 92.

At the side portion of the second connector housing 95, there is formed a flexible lock arm 99 having a lock projection 98. The lock projection 98 is arranged and formed at a leading end of the lock arm 99. The lock arm 99 is formed so as to be capable of flexing toward the side portion of the second connector housing 95. The lock arm 99 is formed in the shape of a cantilevered arm.

A frame 100 has a lock release arm operating slit 101. The lock release arm operating slit 101 is formed so as to notch an end portion 102 that is a side portion of the frame 100 and a side toward which the second connector 94 is drawn. The lock release arm operating slit 101 is formed, in the state where the LIF connector 103 is formed, in such a shape as to be capable of facing the lock release arm 97 of the first connector 91.

In FIG. 12, when the LIF connector 103 is formed, the lock projection 98 is caught at the lock part 96 of the first connector 91 at this time, whereby an engagement between the first connector 91 and the second connector 94 is formed (an operation of rotating the frame 100 becomes impossible). For example, after the LIF connector 103 is detached from the vehicle body panel, when the worker holds the second connector 94 side with his left hand and simultaneously presses down the lock release arm 97 through the lock release arm operating slit 101 with his forefinger, the lock arm flexes and the engagement between the lock part 96 and the lock projection 98 is released, so that the engagement is released.

When the engagement is released (refer to FIG. 11), the operation of the frame 100 becomes possible. Therefore, when the worker, while holding the second connector 94 side with his left hand, rotates the frame 100 in a direction of an arrow Q with his right hand, the second connector 94 separates from the first connector 91 by the working of a not-shown LIF mechanism part.

Since the finger after pressing down the lock release arm 97 is not caught at the frame 100 as known from the shape of the lock release arm operating slit 101, the worker can separate the second connector 94 from the first connector 91 without passing the part from one hand to the other.

Figure 13:
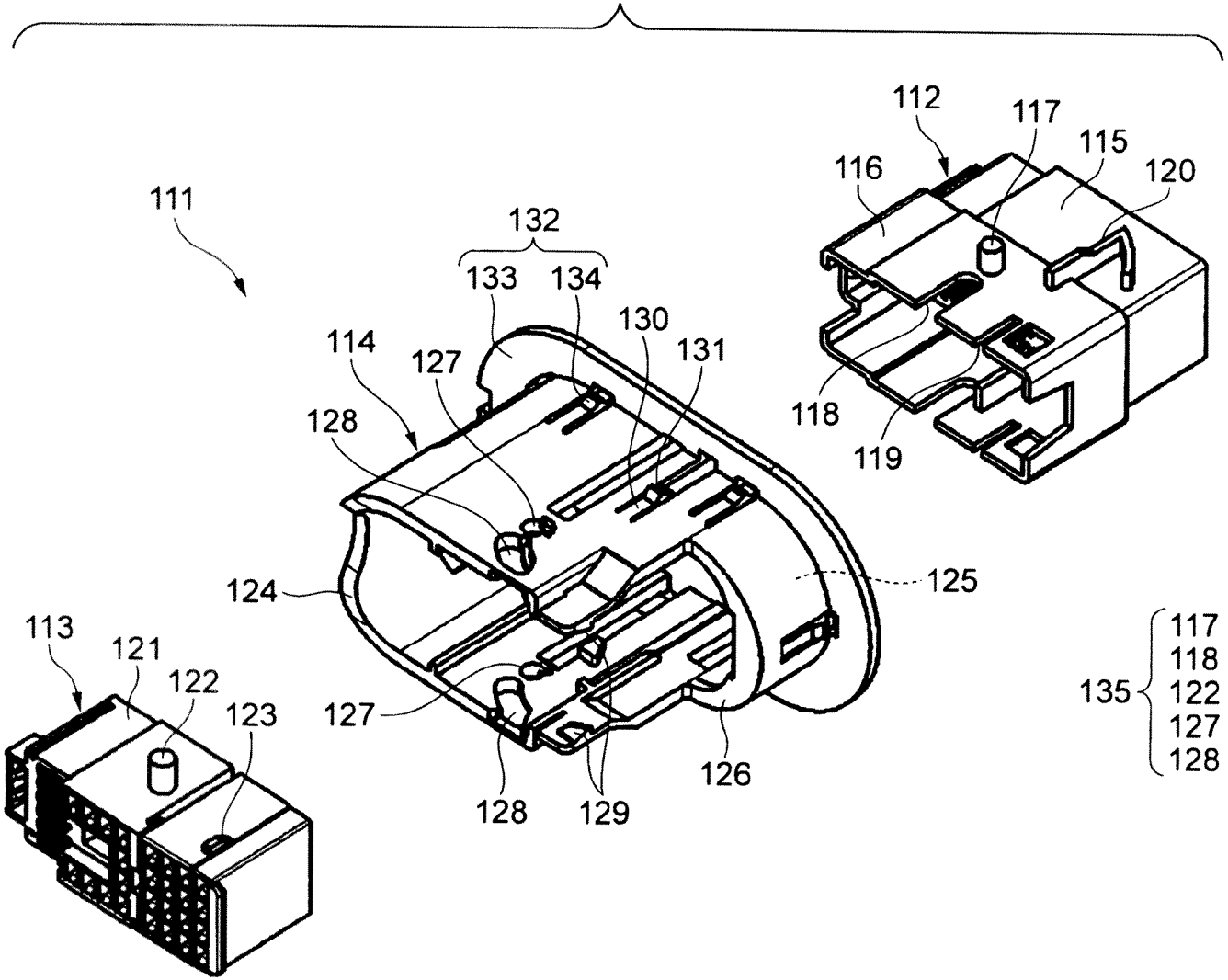
[FIG. 13] It is an exploded perspective view showing a vehicle body panel fixing LIF connector according to the fifth embodiment of the invention.
Figure 14:
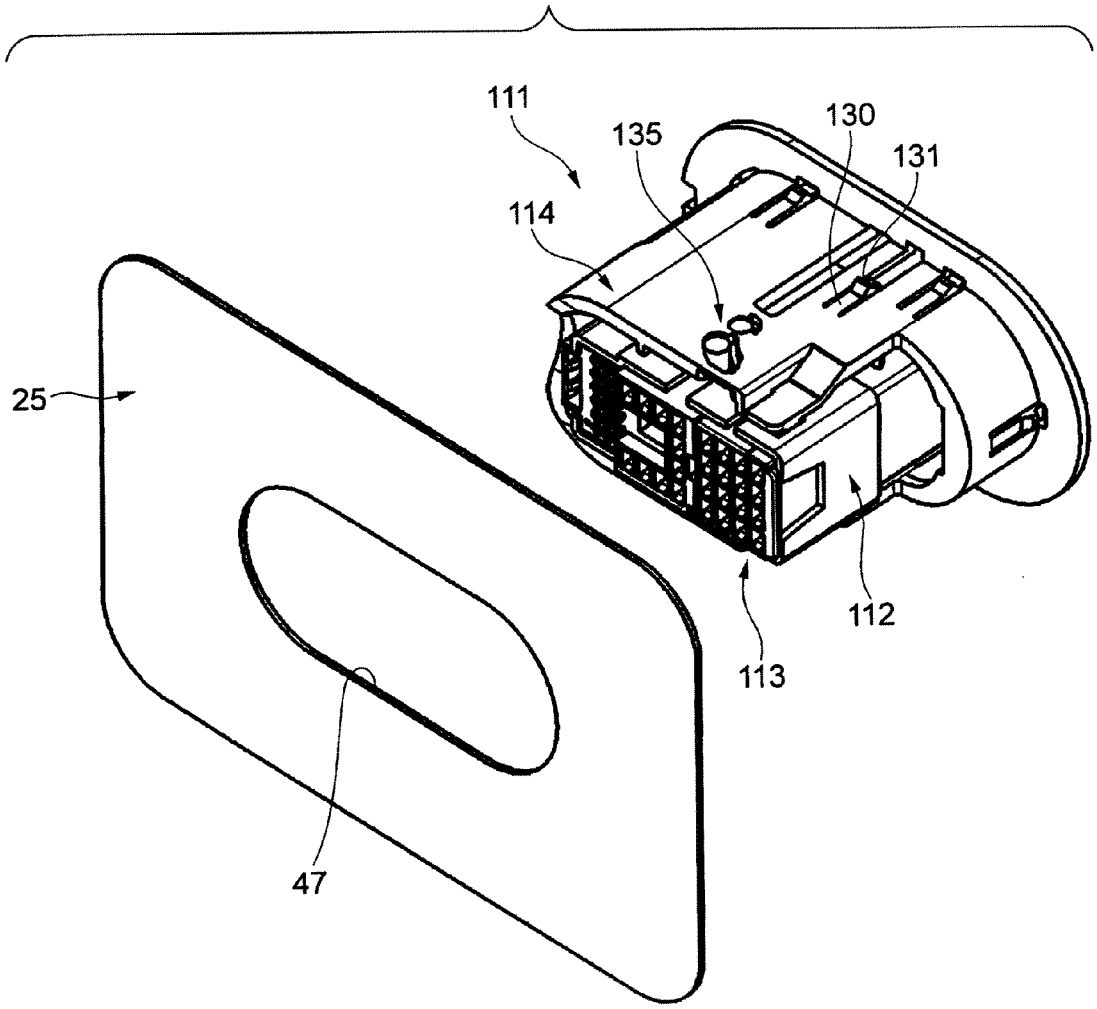
[FIG. 14] It is a perspective view showing a state immediately before the vehicle body panel fixing LIF connector is fitted to a vehicle body panel.
Figure 15:
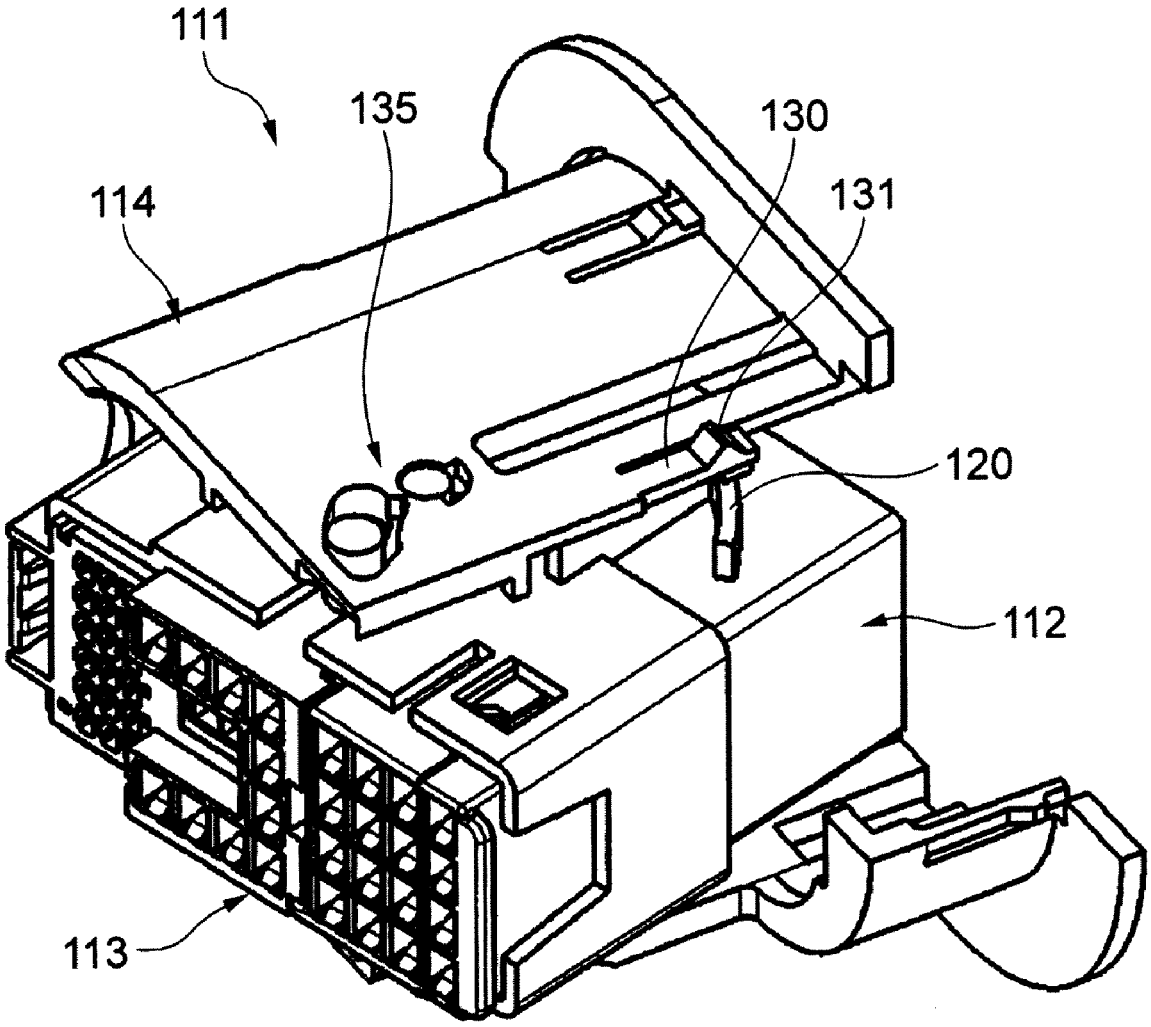
[FIG. 15] It is a perspective view showing a halfway fitting state (including a partial section) between a second connector and a first connector.
Figure 16:
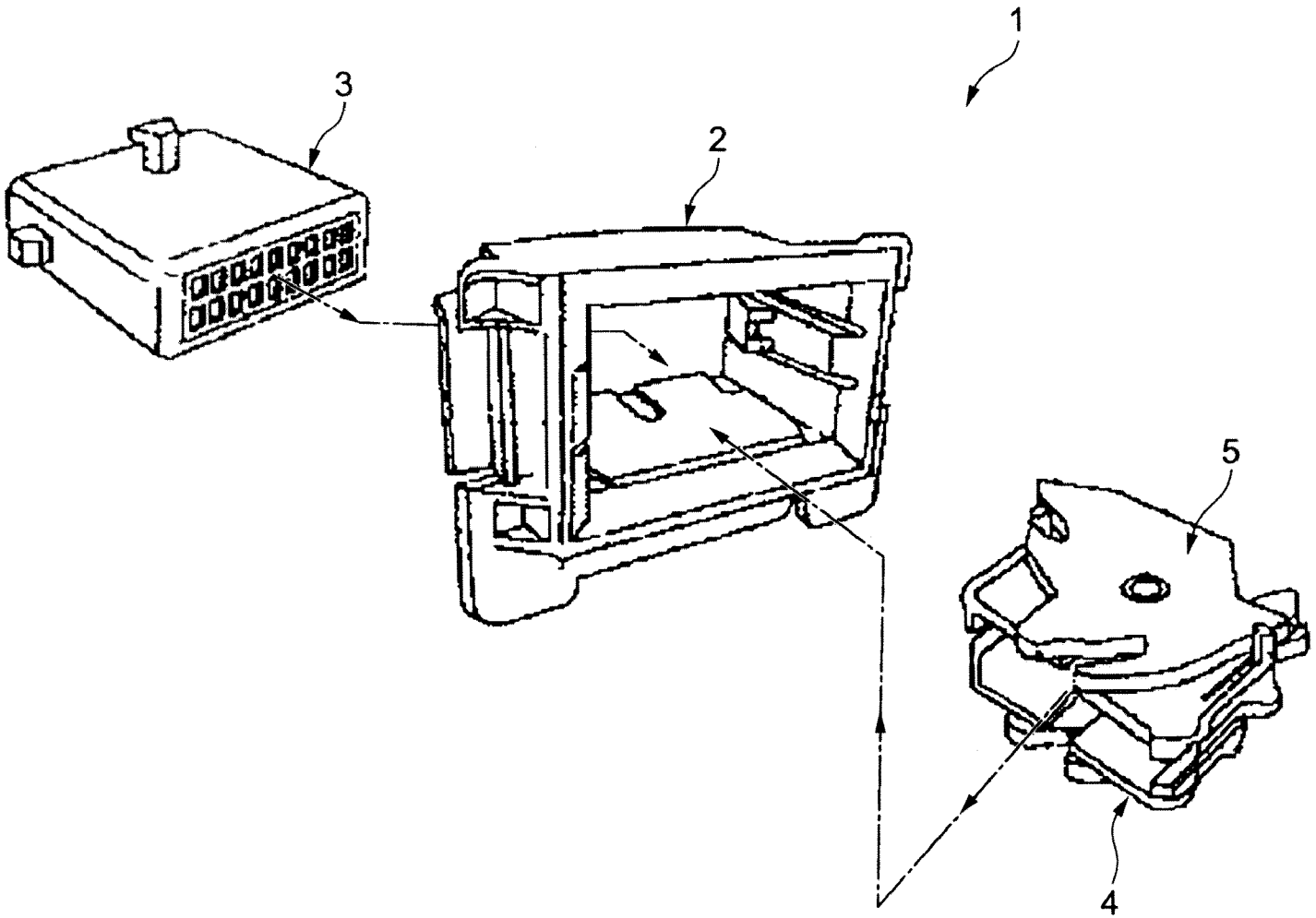
[FIG. 16] It is an exploded perspective view of a conventional vehicle body panel fixing LIF connector.

Next, referring to FIGS. 13 to 15, a fifth embodiment of the invention is described. FIG. 13 is an exploded perspective view showing a LIF connector according to the fifth embodiment of the invention. Further, FIG. 14 is a perspective view showing a state immediately before the LIF connector is fitted to a vehicle body panel. Further, FIG. 15 is a perspective view showing an incomplete engagement between a second connector and a first connector (including a partial section).

In FIG. 13, a LIF connector 111 includes a first connector 112, a second connector 113, and a frame 114. The LIF connector 111 includes three parts. The first connector 112 is assembled to the frame 114 in an accommodated state. The first connector 112 and the second connector 113 are fitted to each other by an operation of the frame 114. When the first connector 112 and the second connector 113 are fitted to each other thereby to form the LIF connector 111, this LIF connector 111 is locked and fixed to a vehicle body panel 25 (refer to FIG. 14).

The first connector 112 includes a first connector housing 115 made of insulating synthetic resin, and a male metallic terminal (not shown) accommodated in this first connector housing 115. In the first connector housing 115, a connector fitting part 116 is formed. Further, in the first connector housing 115, a fulcrum boss 117, an application point boss relief groove 118, and a temporary lock projection relief groove 119 are formed (these are formed respectively in pairs). Further, in the first connector housing 115, an arm flexure regulating part 120 is formed. The arm flexure regulating part 120 is arranged and formed as described in the figure, and works in case that a center axis of the first connector 112 is not parallel to a center axis of the frame 114 (in case that the first connector 112 and the second connector are put in an incomplete engagement).

The second connector 113 includes a second connector housing 121 made of insulating synthetic resin, and a female metallic terminal (not shown) accommodated in this second connector housing 121. In the second connector housing 121, an application point boss 122 and a lever temporary lock release projection 123 are formed (these are formed respectively in pairs).

The frame 114 has a function as a lever for engaging the first connector 1122 and the second connector 113 to each other and a function as a connector holder for locking the first connector 112 and the second connector 113 which are in the fitting state to the vehicle body panel 25 (refer to FIG. 14). The frame 114 is formed, for example, in the substantially cylindrical shape as shown in the figure. The frame 114 is formed so that its front portion and back portion, and a part of its side portion open. Reference numeral 124 denotes an opening portion of the above front portion. Further, reference numeral 125 denotes an opening portion of the above back portion. Further, reference numeral 126 denotes an opening portion of a part of the above side portion.

In the frame 114, a fulcrum boss guide hole 127, an application point boss guide groove 128, and a lever temporary lock projection 129 are formed (these are formed respectively in pairs). Further, in the frame 114, a lever halfway detecting arm 130 is formed. The lever halfway detecting arm 130 is formed at the side portion of the frame 114. The lever halfway detecting arm 130 has an outward convex portion 131 which abuts on the vehicle body panel 25 (refer to FIG. 14), and is formed so as to have flexibility inward the frame 114. The lever halfway detecting arm 130 is formed in the shape of a cantilevered arm. Regarding the lever halfway detecting arm 130, in the incomplete engagement between the first connector 112 and the second connector 113, the inward flexure is regulated by the arm flexure regulating part 120 of the first connector 112.

A panel locking structure part 132 that becomes locking structure for the vehicle body panel 25 (refer to FIG. 14) is formed at plural portions of the frame 114. The panel locking structure part 132 includes a panel butting flange 133 and a panel lock arm 134.

The fulcrum boss 117, the application point boss relief groove 118, the application point boss 122, the fulcrum boss guide hole 127, and the application point boss guide groove 128 function as an LIF mechanism part 135 (function similarly to in the above first embodiment).

In the above configuration and structure, in a state where the first connector 112 and the second connector 113 which constitute the LIF connector 111 are fitted completely as shown in FIG. 14, the outward convex portion 131 of the lever halfway detecting arm 130 abuts on the vehicle body panel 25, and thereafter the lever halfway detecting arm 130 flexes toward the first connector 112 side. Hereby, the abutting state between the outward convex portion 131 and the vehicle body panel 25 is released, and pressing of the LIF connector 111 toward the vehicle body panel 25 becomes possible. Accordingly, locking and fixing to the vehicle body panel 25 can be advanced.

On the other hand, as shown in FIG. 15, in case that the LIF connector 111 is about to be attached to the vehicle body panel 25 (refer to FIG. 14) in the state where the first connector 112 and the second connector 113 are under the incomplete engagement, the outward convex portion 131 of the lever halfway detecting arm 130 abuts on the vehicle body panel 25. At this time, though the lever halfway detecting arm 130 intends to flex toward the first connector 112 side, the flexure is prohibited by the arm flexure regulating part 120 of the first connector 112. Hereby, the abutting state between the outward convex portion 131 of the lever halfway detecting arm 130 and the vehicle body panel 25 is maintained, and pressing of the LIF connector 111 toward the vehicle body panel 25 becomes impossible. Accordingly, the incomplete engagement is detected.

As described above, the advantage according to the fifth embodiment is that the incomplete engagement between the first connector 112 and the second connector 113 is able to be detected.

The structure of prohibiting the flexure of the lever halfway detecting arm by the arm flexure regulating part can be applied to other type connectors locked and fixed to the vehicle body panel. As a concrete example of their type connectors, there is a connector which does not require a LIF mechanism part and have no rotational operation. This type of connector includes a first connector, a second connector, and a connector holder for locking and fixing these connectors to a vehicle body panel in a state where these connectors are fitted. An arm flexure regulating part formed at the first connector regulates flexure of a lever halfway detecting arm of the connector holder in the halfway fitting state, and permits the flexure in the completely fitting state.

In the structure of prohibiting the flexure of the lever halfway detecting arm by the arm flexure regulating part, unnecessary displacement is not produced in the lever halfway detecting arm in the halfway fitting state. Therefore, an advantage that the LIF connector has a structure in which creep deformation of the lever halfway detecting arm is taken into consideration.

Various modifications of the invention can be made without departing from the spirit of the invention.

What is claimed is:

1. A low insertion force connector fixing a vehicle body panel comprising:

a frame including a first guide groove and a panel locking structure configured to be engaged with the vehicle body panel;

a first connector connected to the frame so as to be rotated and including a second guide groove; and a second connector having a first boss which is inserted into the first and the second guide groove, wherein the frame has an arm slit and the first connector has an arm jutting out from the arm slit so that the arm provide a rotational force to the first connector when the low insertion force connector is fitted into the vehicle body panel.

2. The low insertion force connector according to claim 1, wherein the first and the second connector are engaged by rotating the frame from a position where the first boss is inserted into the first and the second guide groove at the same time.

3. The low insertion force connector according to claim 1, wherein the frame includes a second boss and the first connector includes a boss guide groove, wherein the frame and the first connector are rotatably connected by the engagement between the boss and the boss guide groove.

4. The low insertion force connector according to claim 1, wherein the frame forms a first opening through which the first connector is inserted when the frame and the first connector are connected.

5. The low insertion force connector according to claim 1, wherein the first connector has a second opening through which the second connector is inserted into the first connector when the first boss is inserted into the first and second guide groove.

6. The low insertion force connector according to claim 1, wherein the frame has a grommet.

7. The low insertion force connector according to claim 1, wherein the panel locking structure includes a flange and a lock arm so that the vehicle body panel is interposed between the flange and the lock arm.

8. The low insertion force connector according to claim 1, wherein the first connector includes a second boss and the frame includes a boss guide groove, wherein the frame and the first connector is rotatably connected by the engagement between the boss and the boss guide groove.

9. The low insertion force connector according to claim 8, wherein the first guide groove is formed continuously from the first opening.

10. The low insertion force connector according to claim 9, wherein the second guide groove is formed continuously from the second opening.

11. A low insertion force connector fixing a vehicle body panel comprising:

a frame including a first guide groove and a panel locking structure configured to be engaged with the vehicle body panel;

a first connector connected to the frame so as to be rotated and including a second guide groove; and a second connector having a first boss which is inserted into the first and the second guide groove;

wherein the frame has a flexible arm and the first connector has a projection part which prevents the flexible arm from vending under incomplete engagement between the first and the second connector.

12. A low insertion force connector fixing a vehicle body panel comprising:

a frame including a first guide groove and a panel locking structure configured to be engaged with the vehicle body panel;

a first connector connected to the frame so as to be rotated and including a second guide groove; and a second connector having a first boss which is inserted into the first and the second guide groove;

wherein the frame has an arm operating slit, the first connector has a lock part including a flexible lock release arm, and the second connector has a lock arm including lock projection, wherein the lock part is engaged with the lock projection under the engagement between the first and the second connector, and the flexible lock release arm vends by pushing through the arm operating slit so as to release the engagement between the lock projection and the lock part.

13. A low insertion force connector fixing a vehicle body panel comprising:

a frame including a first guide groove and a panel locking structure configured to be engaged with the vehicle body panel;

a first connector connected to the frame so as to be rotated and including a second guide groove; and a second connector having a first boss which is inserted into the first and the second guide groove;

wherein the frame has a temporal lock projection, the first connector has a temporal lock groove, and the second connector has a temporal lock release projection, wherein the temporal lock projection and the temporal lock groove connected when the frame and the first connector are connected, and the temporal lock release projection release the connection between the temporal lock projection and the temporal lock groove when the first boss is inserted into the first and the second guide groove.

* * * * *